US005902492A

United States Patent [19]

Suzuki et al.

[11] Patent Number: 5,902,492

[45] **Date of Patent: *May 11, 1999**

[54] LIQUID JET RECORDING HEAD MANUFACTURING METHOD BY ANISOTROPIC ETCHING

[75] Inventors: Takumi Suzuki; Hirokazu Komuro, both of Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/693,008

[22] Filed: Aug. 6, 1996

[30] Foreign Application Priority Data

Aug. 9, 1995 [JP] Japan ..... 7-224683

[51] Int. Cl.[6] ..... B41J 2/05

[52] U.S. Cl. ..... 216/27; 347/65; 29/890.1

[58] Field of Search ..... 347/63, 65; 29/890.1; 216/27

[56] References Cited

U.S. PATENT DOCUMENTS

| | | | |
|---|---|---|---|
| 4,216,477 | 8/1980 | Matsuda et al. | 346/140 R |
| 4,313,124 | 1/1982 | Hara | 346/140 R |
| 4,345,262 | 8/1982 | Shirato et al. | 346/140 R |
| 4,417,251 | 11/1983 | Sugitani | 346/1.1 |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 4,970,532 | 11/1990 | Komuro et al. | 346/140 R |
| 5,068,006 | 11/1991 | Fisher | 216/27 |
| 5,148,595 | 9/1992 | Doggett et al. | 29/840 |
| 5,332,466 | 7/1994 | Nozawa | 216/27 |
| 5,443,687 | 8/1995 | Koyama et al. | 216/27 |
| 5,508,725 | 4/1996 | Goto et al. | 347/65 |
| 5,530,465 | 6/1996 | Hasegawa et al. | 347/70 |

FOREIGN PATENT DOCUMENTS

| | | | |
|---|---|---|---|
| 561482 | 9/1993 | European Pat. Off. | 347/63 |
| 0609012A2 | 8/1994 | European Pat. Off. . | |
| 0652108A2 | 5/1995 | European Pat. Off. . | |
| 0656261A2 | 6/1995 | European Pat. Off. . | |
| 747222 | 12/1996 | European Pat. Off. . | |
| 54-56847 | 5/1979 | Japan . | |
| 54-150127 | 11/1979 | Japan . | |
| 56-123869 | 9/1981 | Japan . | |
| 59-123670 | 7/1984 | Japan . | |
| 59-138461 | 8/1984 | Japan . | |
| 60-71260 | 4/1985 | Japan . | |
| 62-253457 | 11/1987 | Japan . | |
| 2-297445 | 7/1990 | Japan . | |
| 3-101954 | 4/1991 | Japan . | |
| 6-171089 | 6/1994 | Japan . | |

*Primary Examiner*—Edgar Burr
*Assistant Examiner*—Daniel J. Colilla
*Attorney, Agent, or Firm*—Fitzpatrick, Cella, Harper & Scinto

[57] ABSTRACT

A liquid jet recording head comprising discharge energy generating means for generating discharge energy in the recording liquid, and a liquid flow passage forming substrate for forming liquid flow passages through which the recording liquid is flowed toward the discharge ports, characterized in that the surface of said liquid flow passage forming substrate and the lateral faces of said liquid flow passages are constituted of a plane of single crystalline silicone and a pair of planes perpendicular thereto, respectively.

3 Claims, 5 Drawing Sheets

LIQUID JET RECORDING HEAD MANUFACTURING METHOD BY ANISOTROPIC ETCHING

BACKGROUND OF THE INVENTION

1. Field of the Invention

The present invention relates to a liquid jet recording head for use in a liquid jet recording apparatus of an ink jet system for discharging the recording liquid (ink) as liquid droplets from the discharge ports (orifices), and a manufacturing method thereof, as well as a liquid jet recording apparatus with said liquid jet recording head mounted thereon.

2. Related Background Art

The liquid jet recording apparatuses of ink jet systems are very sensitive to disturbance, while features such as sufficiently high frequencies of producing droplets, ease of achieving the higher speed, higher precision, and multi-color printing are greatly expected in the future.

A liquid jet recording head of such a liquid jet recording apparatus comprises a substrate having discharge energy generating elements, and a nozzle layer (liquid flow passage forming layer) for forming liquid flow passages or a liquid chamber in communication to discharge ports (orifices) thereon, said substrate being typically subjected to thermal oxidation of the surface of a Si substrate of single crystal, and then formed with discharge energy generating elements such as electrothermal converting elements by well-known photolithography, its surface covered with an electrically insulating layer made of $SiO_2$, SiC, or $Si_3N_4$, and a protective layer such as a Ta film for preventing damage (cavitation erosion) to discharge energy generating elements caused by mechanical impact in discharging the recording liquid, with a $Ta_2O_5$ film provided to reinforce the intimate contact between the electrically insulating layer and the Ta film, if necessary. Also, a glass ceiling plate with an inlet opening for supplying the recording liquid such as ink to the nozzle layer is laid on the nozzle layer, said ceiling plate being bonded to the nozzle layer by adhesive.

The manufacturing methods for the liquid jet recording head with the above constitution can be classified into the four types as follows.

(1) Patterning a glass ceiling plate bonded with a dry film, and joining it to a substrate (see Japanese Laid-Open Patent Application No. 56-123869).

(2) Molding a nozzle layer made of resin by injection molding, and joint it to a substrate (see Japanese Laid-Open Patent Application No. 3-101954).

(3) Providing a resist pattern on a substrate, applying a resin film thereto, joining a ceiling plate thereto, curing the resin film, and then dissolving away the resist (see Japanese Laid-Open Patent Application No. 62-253457).

(4) Subjecting the surface of a second substrate which is comprised of a Si substrate of single crystal, as parent material, like a first substrate (heater board) having discharge energy generating elements, to anisotropic etching, to create V-character grooves, and bonding this substrate as a nozzle layer to the first substrate. Processing the surface of the second substrate constituting the nozzle layer to be a (100) plane, and forming the grooves of V-character in cross section by anisotropic etching at an etching rate for (111) plane of substantially zero (see Japanese Laid-Open Patent Application No. 54-150127).

In recent years, the liquid jet recording apparatus has advanced for the faster speed, greater precision, and higher image quality, and therefore, the development of liquid jet recording heads with ease of fabrication for the higher density of liquid flow passages, and the capability of higher discharge frequency, is desired. Also, one way of printing on plain paper is to use a strong base ink with the addition of urea. In this case, it is also necessary to improve the ink resistance property of structural members constituting the liquid flow passages in the liquid jet recording head, and the chamber.

However, according to the above-mentioned conventional arts, the liquid jet recording heads fabricated by the methods of (1) to (3), as previously described, all have the nozzle layer formed of resin, and are significantly limited in the materials from the viewpoint of the ink resistance property. Also, to promote the higher density of liquid flow passages, each liquid flow passage is required to have a high aspect ratio, i.e., a narrow width and greater height in cross section, but with the methods of (1) and (2), which use photosensitive resin, it is difficult to produce a high aspect ratio, and with the method of (3), which adopts the injection molding, it is also difficult to attain a sufficient shape precision if the liquid flow passages have a high aspect ratio.

To provide the liquid jet recording head operable at high frequencies for discharging, the cross-sectional dimensions of each liquid flow passage are required to be large, and to avoid the larger dimensions of the liquid jet recording head, the liquid flow passages are also required to have a high aspect ratio.

A method of (4) is superior in the ink resistance property, satisfactory in heat resistance, and simple in the manufacturing process, because the second substrate for the nozzle layer is the same Si material as the first substrate for the heater board, further with the advantages of having uniform ink wettability and stable discharge performance, owing to the orifice face to which discharge orifices are opened being constructed by the end faces of both Si substrates. However, since the grooves formed by anisotropic etching as above described do not allow the aspect ratio to be changed, and the second substrate has its bottom surface having the V-character shaped grooves facing down toward the heater board and joined thereto, the liquid flow passages with higher density will reduce the unetched width, resulting in unsolved problems of producing a lot of defectives.

SUMMARY OF THE INVENTION

The present invention has been achieved in the light of the aforementioned conventional problems, and its object is to provide a liquid jet recording head in which it is easy to fabricate liquid flow passages having a high aspect ratio and a high shape precision, and accordingly, can significantly promote the higher precision and faster speed of printing, having satisfactory ink resistant property and heat resistance, and stable discharge performance, and a manufacturing method thereof, as well as a liquid jet recording apparatus with said liquid jet recording head mounted thereon.

To accomplish the above object, a liquid jet recording head of the present invention comprises discharge energy generating means for generating discharge energy in the recording liquid, and a liquid flow passage forming substrate for forming liquid flow passages through which the recording liquid is flowed toward the discharge ports, characterized in that the surface of said liquid flow passage forming substrate and the lateral surfaces of said liquid flow passages are constituted of a (110) plane of single crystalline silicon and a pair of (111) planes perpendicular thereto, respectively.

A manufacturing method of a liquid jet recording head according to the present invention is characterized by including the steps of making a liquid flow passage forming substrate having the surface composed of a (110) plane of single crystalline silicon, and subjecting this substrate to anisotropic etching to form liquid flow passages having the lateral surfaces composed of a pair of (111) planes perpendicular to said (110) plane.

It is preferable to include a step of laminating the liquid flow passage forming substrate with liquid flow passages formed on a support substrate for supporting discharge energy generating means.

It is possible to include a step of laminating said liquid flow passage forming substrate on the support substrate before subjecting said liquid flow passage forming substrate to anisotropic etching.

Also, it is possible to include a step of laminating a ceiling plate on said liquid flow passage forming substrate before subjecting said liquid flow passage forming substrate made of single crystalline silicone to anisotropic etching.

This constitution is one of forming liquid flow passages by subjecting the liquid flow passage forming substrate made of single crystalline silicone to anisotropic etching. With the constitution of the present invention, the liquid flow passage forming substrate is fabricated with a (110) plane of single crystalline silicon as the surface, and liquid flow passages having a square cross section with a pair of (111) planes as the lateral faces can be formed by anisotropic etching with an etching rate for the (111) planes perpendicular to said (110) plane substantially equal to zero.

Also, since the liquid flow passages are square in cross section, it is possible to form liquid flow passages with high aspect ratio and high shape precision by increasing the thickness of the liquid flow passage forming substrate, or the etching depth.

If liquid flow passages extending through the liquid flow passage forming substrate are formed by anisotropic etching, by laminating the ceiling plate on the liquid flow passage forming substrate or the liquid flow passage forming substrate on the support substrate before subjecting said liquid flow passage forming substrate to anisotropic etching, it is unnecessary to control the etching depth because the depth of liquid flow passages can be determined only by the thickness of the liquid flow passage forming substrate.

Also, by making the liquid flow passage forming substrate and the support substrate of the same Si substrate, the ink resistant property or heat resistance of the liquid jet recording head can be improved, with the ink wettability around the discharge ports even, to stabilize the discharge performance.

BRIEF DESCRIPTION OF THE DRAWINGS

FIGS. 1A and 1B show liquid jet recording heads in a first example, wherein FIG. 1A is a typical partial perspective view showing a part thereof, and FIG. 1B is a typical partial cross-sectional view showing a part of the cross section in a direction of thickness of a nozzle layer in FIG. 1A.

FIGS. 3A and 3B show liquid jet recording heads in a second example, wherein FIG. 3A is a typical partial cross-sectional view showing a part thereof, and FIG. 3B is a typical partial cross-sectional view showing another cross section.

FIGS. 4A and 4B show liquid jet recording heads in a third example, wherein FIG. 4A is a typical partial cross-sectional view showing a part thereof, and FIG. 4B is a typical partial cross-sectional view showing another cross section.

DETAILED DESCRIPTION OF THE PREFERRED EMBODIMENTS

The embodiments of the present invention will be described below with reference to the drawings.

Figure 1A:
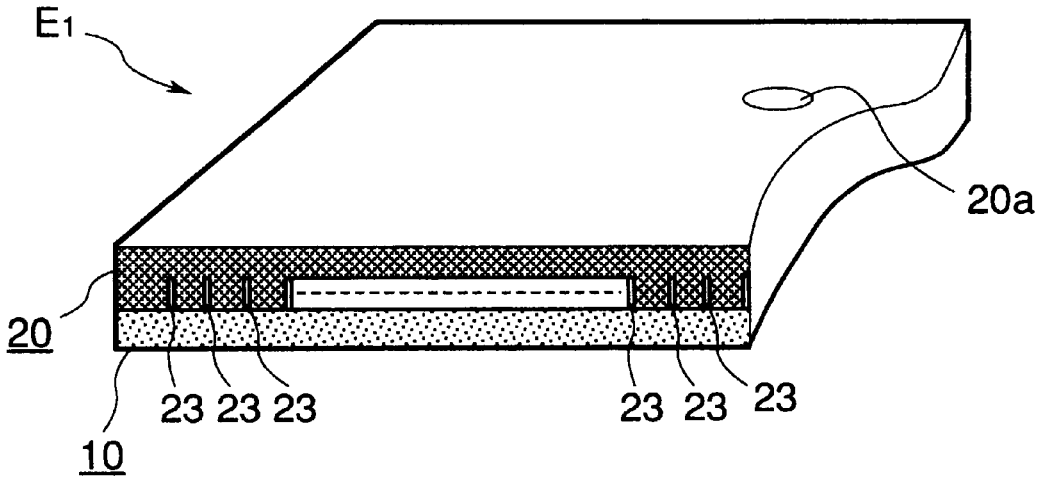
Figure 1B:
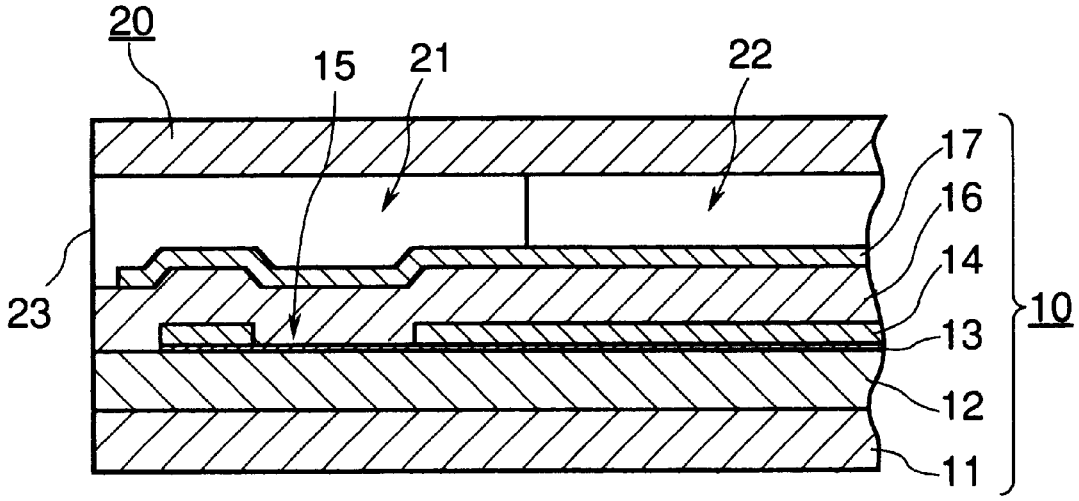

FIGS. 1A and 1B show liquid jet recording heads E1 in the first example, wherein FIG. 1A is a typical partial perspective view showing a part thereof, and FIG. 1B is a typical partial cross-sectional view showing a part of a nozzle layer in cross section in the thickness direction. The liquid jet recording head E1 comprises a substrate (heater board) 10 which is a support substrate having electrothermal converting elements (discharge energy generating elements) which are discharge energy generating means as hereinafter described, and the connecting wires, and the nozzle layer 20 which is a liquid flow passage forming substrate laminated on the substrate 10, the nozzle layer 20 having a plurality of liquid flow passages 21 formed by anisotropic etching as hereinafter described, and a common liquid chamber 22 in communication with them, with an orifice (discharge port) 23 formed at an open end of each liquid flow passage. Also, on the upper face of the nozzle layer 20 is provided an inlet opening 20*a* for supplying the ink which is the recording liquid to the common liquid chamber 22.

The substrate 10 comprises a Si substrate 11, a heat accumulating layer 12 formed as a film by thermal oxidation of $SiO_2$ on its surface, a heating resistive layer 13 made of $HfB_2$ formed as a film by sputtering on a predetermined portion of the heat accumulating layer 12, and a connecting wire 14 adhered thereon, the connecting wire 14 being made by forming an Al film on the surface of the heating resistive layer 13, and patterning it by well-known lithography, with a part of the heating resistive layer 13 exposed to an interrupted portion of the connecting wire 14 as a heating portion to constitute an electrothermal converting element 15.

The surface of the connecting wire 14 or the electrothermal converting element 15 is covered with an insulating layer 16 of $Si_3N_4$ formed as a film by bias sputtering, and further the surface of the insulating layer 16 is covered with a protective layer 17 of Ni to prevent damage by cavitation of the ink.

The ink supplied via the inlet opening 20*a* into the common liquid chamber 22 is partly heated and vaporized by each electrothermal converting element 15 within each liquid flow passage 21, and is discharged through each orifice 23 as liquid droplets. At this time, the protective layer 17 protects the electrothermal converting elements 15 from cavitation of the ink.

Figure 2A:
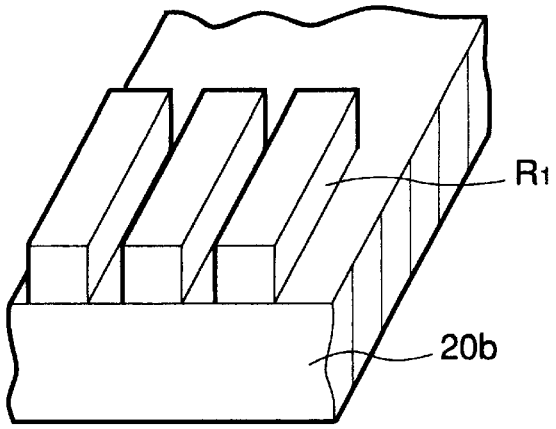
FIGS. 2A, 2B and 2C are explanatory views for showing the steps of manufacturing the liquid jet recording head of FIGS. 1A and 1B.
Figure 2B:
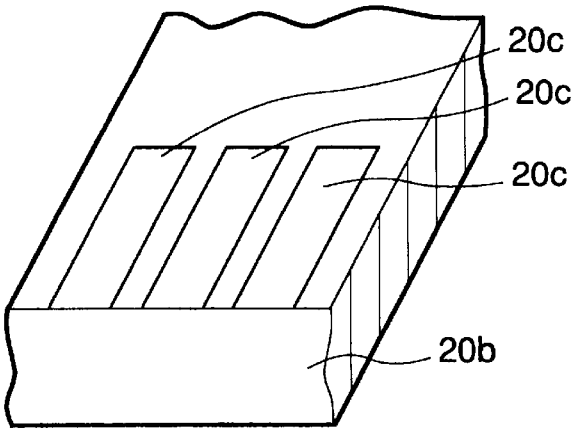
Figure 2C:
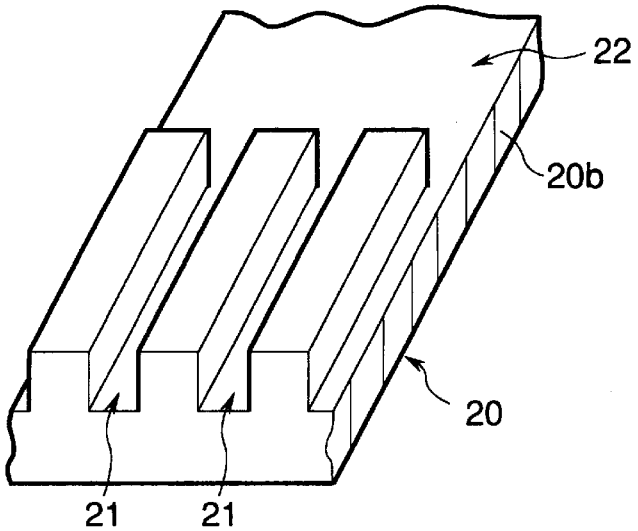

A way of making the nozzle layer 20 is as follows. As shown in FIG. 2A, a second Si substrate 20*b* having a thickness of 1.1 mm with a (110) plane of silicon single crystal as the surface, and made of the same material as the Si substrate 11 in the substrate 10 which is heater board, is fabricated, a thermal oxidized film is formed on its surface, a resist pattern R1 having a shape of liquid flow passage having a width of 25 $\mu$m and a length of 150 $\mu$m is provided, and the thermal oxidized layer is etched with this resist pattern as the mask to remove a portion having a shape of the liquid flow passage and the common liquid chamber, as shown in FIG. 2B. For etching of the thermal oxidized film, a mixed liquid of hydrofluoric acid and ammonium fluoride is used. With the thermal oxidized film 20*c* patterned in this way as the mask, an exposed portion of the Si substrate 20*b* is subjected to anisotropic etching by KOH solution down to a depth of 50 μm, to form the liquid flow passages 21 and the common liquid chamber 22, as shown in FIG. 2C.

Since the anisotropic etching by KOH solution has a fast etching rate for a (110) plane of silicon single crystal, and on the other hand, has an extremely slow etching rate for a (111) plane which is perpendicular to the (110) plane, the liquid flow passage 21*a* becomes groove having a square cross section with its lateral face perpendicular to the surface of the Si substrate 20*b*. The Si substrate 20*b* formed with the liquid flow passages 21 and the common liquid chamber 22 in this way is bonded onto the substrate 10, with its surface facing down, as shown. The adhesives as used herein include an epoxy-type adhesive. An obtained laminate is cut along a predetermined section to open the end of liquid flow passages 21, thereby forming the orifices 23 (see FIGS. 1A and 1B). Note that the common liquid chamber 22 may be preformed on the Si substrate 20*b* by any well-known grooving technique.

Finally, an driving IC is bonded onto an electrode not shown conducting to the connecting wire 14 of the substrate 10 to connect an ink supply tube to the inlet opening 20*a*, thereby completing a liquid jet recording head E1.

As a result of making a print test using the completed liquid jet recording head, it has been found that the discharge performance is extremely excellent.

Since the liquid flow passages of the liquid jet recording head in this example are grooves of square cross section formed by subjecting the Si substrate with a (110) plane of single crystalline silicone as the surface to anisotropic etching along a (111) plane, the depth or width of grooves can be arbitrarily set by controlling the size of the masking opening or the etching time. That is, it is possible to freely make greater the aspect ratio of liquid flow passages, without fear that the unetched width becomes less sufficient in narrowing the interval between liquid flow passages, as will occur with the liquid flow passages comprised of the V-character grooves as seen in cross section, thereby restricting the higher density of liquid flow passages. Accordingly, the higher precision and higher speed for the printing can be greatly promoted.

In addition, since the substrate for the heater board and the nozzle layer are the same material, the ink wettability of the orifice face is uniform, and accordingly, the discharge performance is extremely stable, with the ink resistance property or heat resistance of the nozzle layer being sufficient, thereby resulting in enhanced durability of the liquid jet recording head, and greatly reduced limitations concerning the material of the recording sheet.

Figure 3A:
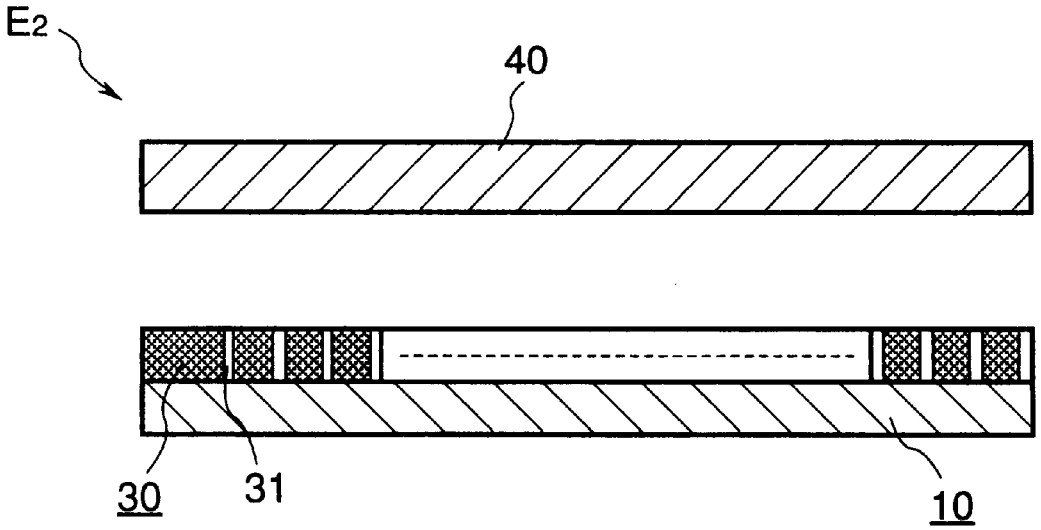
Figure 3B:
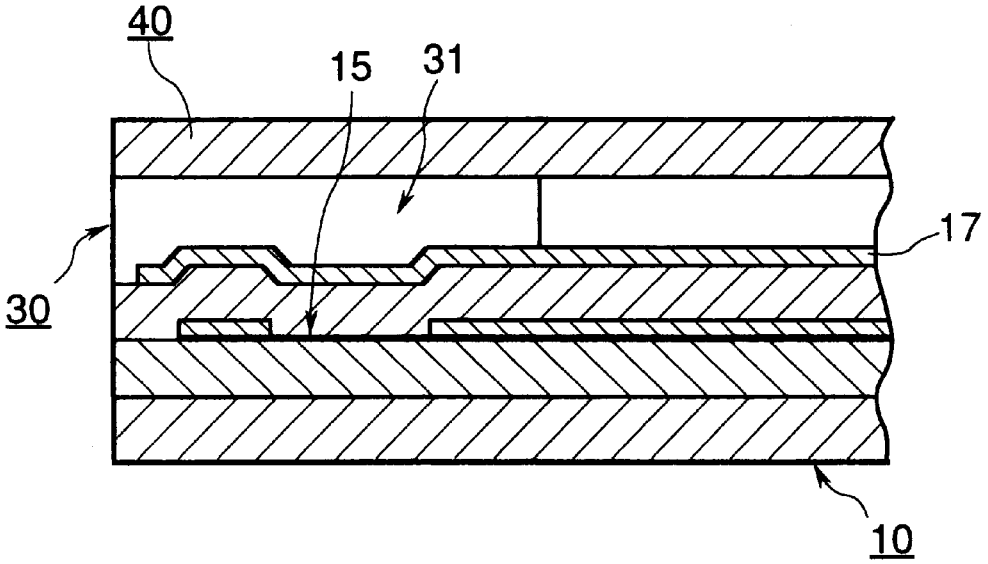

FIGS. 3A and 3B show liquid jet recording heads E2 in the second example, wherein a Si substrate like the Si substrate 20*b* in the first example is first adhered onto a substrate 10 which is a heater board by epoxy type adhesive, and the surface of the Si substrate is abraded to reduce its thickness to a required height, e.g., 50 μm, of liquid flow passages 31. Subsequently, in the same way as the first example, a thermal oxidized film is provided on the surface of the Si substrate, and patterned, to form the openings by anisotropic etching, which are then made into liquid flow passages 31.

Since the surface of the substrate 10 is covered with a protective layer 17 as previously described, the etching is ended if the protective layer 17 is exposed. Accordingly, the height of liquid flow passages 31 is equal to the thickness of the Si substrate. On the nozzle layer 30 formed in this way, a ceiling plate (lid plate ) 40 comprised of a Si substrate made of the same material as this nozzle layer is placed thereon and bonded together. Note that an inlet opening for supplying the ink into a common liquid chamber 32 of the nozzle layer 30 is provided on the ceiling plate 40 in this example.

The substrate 10 for the heater board is the same as in the first example, thus indicated by the same numeral, and no more described.

In this example, the height of liquid flow passages can be determined by the thickness of the Si substrate for the nozzle layer, without need of strictly managing the etching time for anisotropic etching as in the first example.

Figure 4A:
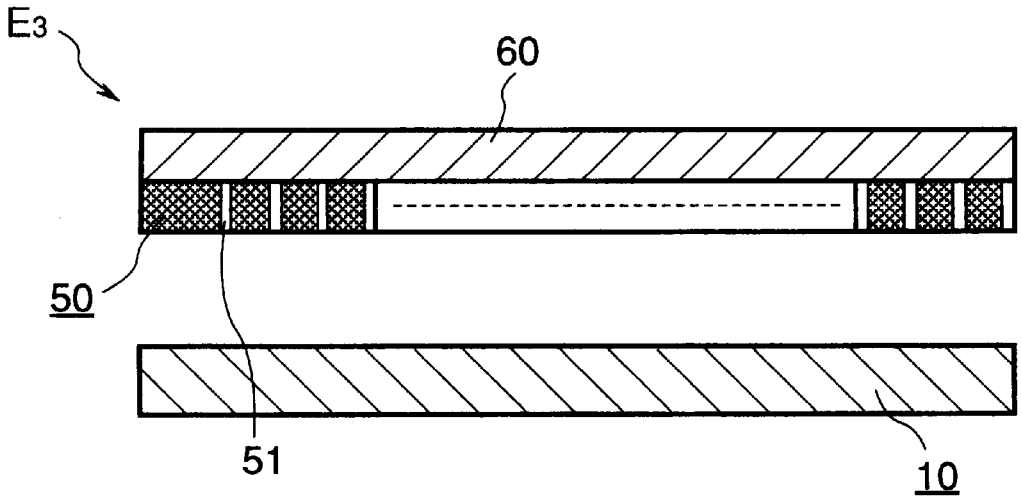
Figure 4B:
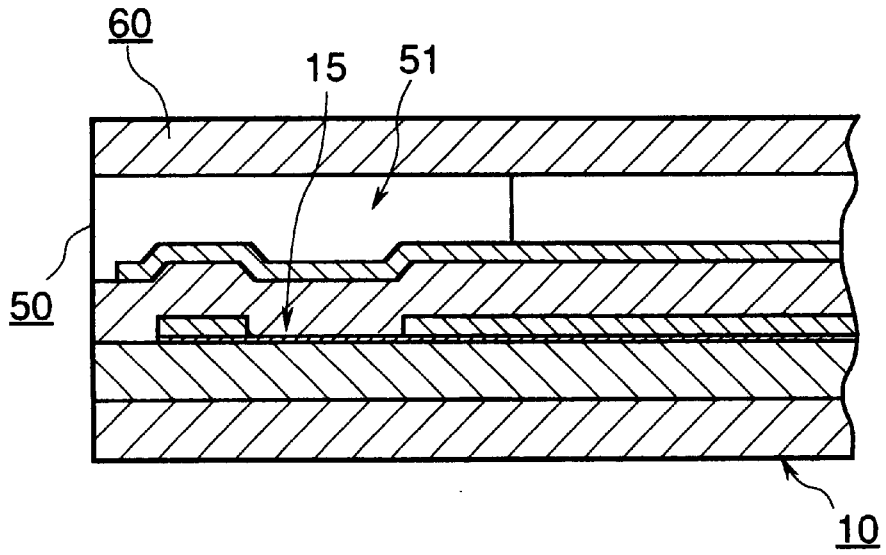

FIGS. 4A and 4B show liquid jet recording head E3 in the third example. This head is fabricated by first integrating a Si substrate for a nozzle layer 50 with a Si substrate for a ceiling plate (lid plate) 60, abrading the surface of the Si substrate for the nozzle layer down to a predetermined thickness in the same way as the second example, then forming liquid flow passages 51 by anisotropic etching, and bonding it together with a substrate 10 which is heater board.

The juncture between the Si substrate for the nozzle layer 50 and the ceiling plate (lid plate) 60 is accomplished by heating both substrates, which are integrated together, up to 800° C. in the nitrogen atmosphere for thermal fusion of the joining faces thereof. Since the nozzle layer 50 and the ceiling plate 60 can be strongly bonded by thermal fusion, the liquid jet recording head which is superior in ink resistance property and the mechanical strength can be obtained.

Figure 5:
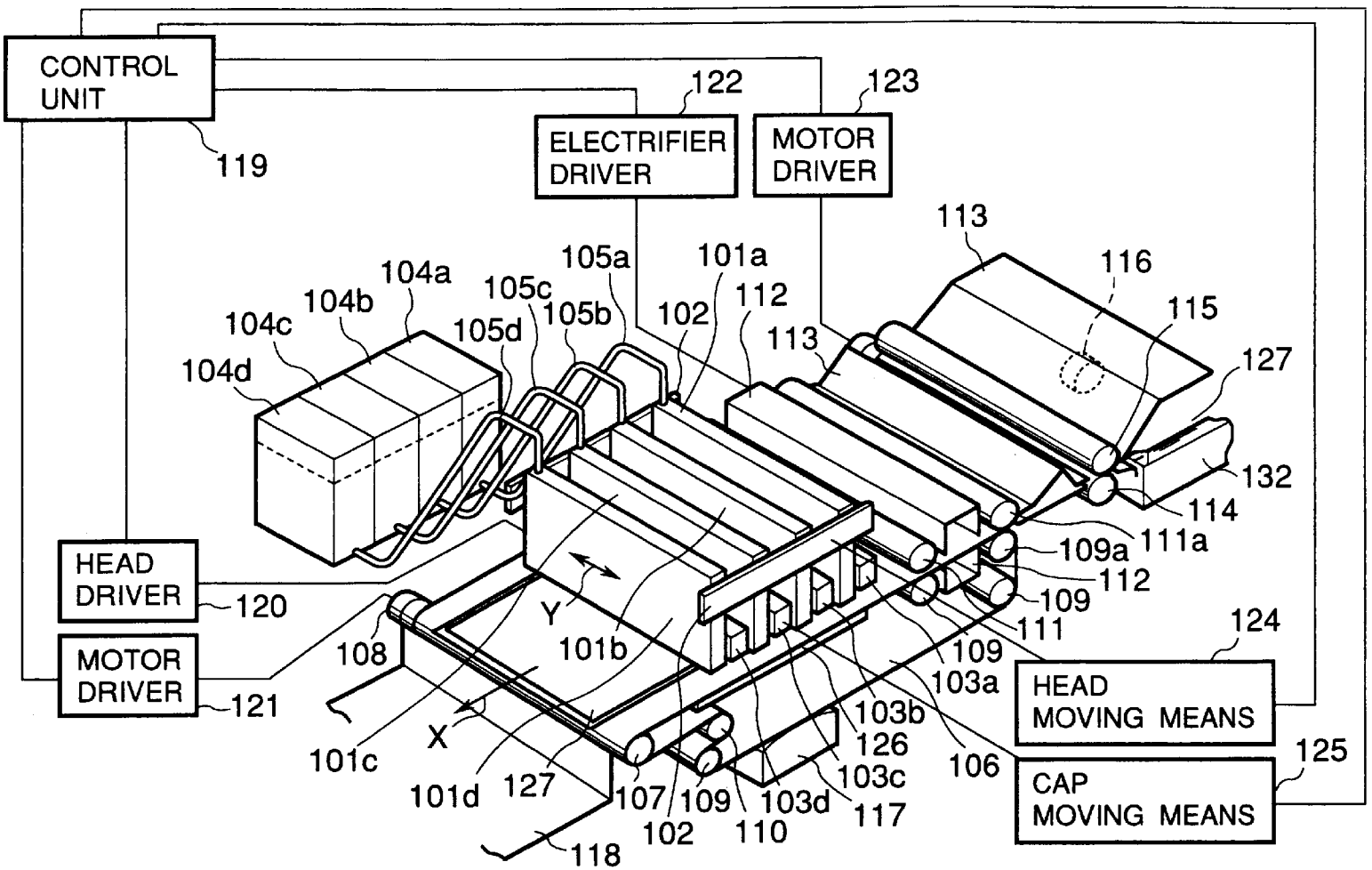
FIG. 5 is a view showing a liquid jet recording apparatus.

A liquid jet recording apparatus to which the liquid jet recording head of the present invention is applied, as shown in FIG. 5, will be described below.

In FIG. 5, 101*a* to 101*d* are liquid jet recording heads of line type (hereinafter referred to as "heads"), which are securely supported by a holder 102 which is a support in a direction of the arrow X with a predetermined spacing therebetween, parallel to one another. On the bottom face of each head 101*a* to 101*d*, discharge ports are provided, directed downwardly, at an interval of 16 openings/mm per column along a direction of the arrow Y, thereby enabling the recording in a width of 216 mm.

Each of these recording heads 101*a* to 101*d* is a system of discharging the recording liquid, using heat energy, under the control of discharging by a head driver 120.

Note that a head unit containing the heads 101*a* to 101*d* and the holder 102 is composed to be movable vertically by head moving means 124.

Note that the caps 103*a* to 103*d* disposed corresponding to the heads 101*a* to 101*d* and adjacent to the bottom portion thereof contain an ink absorbing member such as a sponge internally.

The caps 103*a* to 103*d* are securely supported by a holder, not shown, a cap unit containing the holder and the caps 103*a* to 103*d* are composed to be movable in a direction of the arrow X by cap moving means 125.

The heads 101*a* to 101*d* are supplied with color inks of cyan, magenta, yellow and black from the ink tanks 104*a* to 104*d* through the ink supply tubes 105*a* to 105*d*, respectively, thereby allowing the color recording.

Also, this ink supply makes use of the capillary phenomenon of discharge ports of the head, with the liquid level of each ink tank 104*a* to 104*d* being set a predefined distance below the location of discharge ports.

A belt 106 conveys the recording sheet 127 which a recording medium, and is comprised of an electrifiable seamless belt.

The belt 106 is stretched around a drive roller 107, idle rollers 109, 109*a*, and a tension roller 110 along a predetermined path to connect to the drive roller 107, and is run by a belt drive motor 108 which is driven by a motor driver 121.

Also, the belt 106 is run immediately below the discharge ports for the heads 101*a* to 101*d* in the direction of the arrow X, and is suppressed from vibrating downwards by a fixing support member 126.

Under the belt 106 as shown, a cleaning unit 117 is disposed for cleaning away the paper powder sticking to the surface of the belt 106.

An electrifier 112 for electrifying the belt 106 is turned on or off by an electrifier driver 122, so that the recording sheet 127 is adsorbed onto the belt 106 owing to an electrostatic adsorbing force of this electrification.

Disposed before and after the electrifier 112 are pinch rollers 111, 111*a* to press the recording sheet 127 to be conveyed onto the belt 106, in cooperation with the idle rollers 109, 109*a*.

The recording sheets 127 within a paper supply cassette 132 are fed one by one by rotation of a paper supply roller 116, conveyed by a conveying roller 114 which is driven by the motor driver 123 and a pinch roller 115 in the direction of the arrow X to an angled guide 113. The angled guide 113 has an angled space permitting the recording sheet 127 to be flexed.

The recording sheet 127 which has been recorded is exhausted into a paper exhaust tray 118.

The head driver 120, head moving means 124, cap moving means 125, the motor drivers 121, 123, and the electrifier driver 122 are all controlled by a control unit 119.

The present invention brings about excellent effects particularly in a recording head or recording apparatus of a so-called ink jet recording system for recording by forming flying liquid droplets using heat energy among various liquid jet recording systems.

As to its representative constitution and principle, for example, one practiced by use of the basic principle disclosed in, for example, U.S. Pat. Nos. 4,723,129 and 4,740,796 is preferred. This system is applicable to any of the so-called on-demand type and the continuous type.

Briefly describing this recording system, by supplying a discharge signal from a drive circuit to electrothermal converting elements which are discharge energy generating elements arranged corresponding to the sheets holding the recording liquid (ink) or liquid flow passages, namely, by applying at least one drive signal which gives rapid temperature elevation producing film boiling phenomenon, and exceeding nucleus boiling, to the recording liquid (ink), corresponding to recording information, heat energy is generated to effect film boiling at the heat acting surface of the recording head. In this way, the bubbles within the recording liquid (ink) can be formed corresponding one-to-one to the driving signals to the electrothermal converting elements, and therefore this system is particularly effective for the recording of on-demand type. By discharging the liquid (ink) through an opening for discharging by growth and shrinkage of this bubble, at least one droplet is formed. By making these driving signals into the pulse shapes, growth and shrinkage of the bubbles can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging orifice, liquid channels, and electrothermal converting element (linear liquid channel or right-angled liquid channel) as disclosed in the above-mentioned respective specifications, the constitution by use of U.S. Pat. Nos. 4,558,333 or 4,459,600 disclosing the constitution having the heat acting portion arranged in the flexed region is also included in the present invention.

In addition, the present invention can be also effectively made the constitution as disclosed in Japanese Laid-Open Patent Application No. 59-123670 which discloses the constitution using a slit common to a plurality of electrothermal converting elements as the discharging portion of the electrothermal converting element or Japanese Laid-Open Patent Application No. 59-138461 which discloses the constitution having an opening for absorbing a pressure wave of heat energy correspondent to the discharging portion.

Further, the present invention is effectively usable for a recording head of the full line type having a length corresponding to the maximum width of the recording medium which can be recorded by the recording device. This full-line head may take either a full-line constitution comprised of the combination of a plurality of recording heads or a constitution of one full-line recording head integrally formed.

In addition, the present invention is effective for the use of a recording head of the freely exchangeable chip type which enables electrical connection to the main device or supply of ink from the main device by being mounted on the main device, or a recording head of the cartridge type which is integrated on the recording head itself.

Also, addition of a restoration means or preliminary auxiliary means, etc. to the recording head is preferable, because the recording apparatus is further stabilized. Specific examples of these may include, for the recording head, capping means, cleaning means, pressure or suction means, electrothermal converting elements or another type of heating elements, or preliminary heating means according to a combination of these, and it is also effective for performing stable recording to add preliminary discharge mode means which performs discharging separate from recording.

As the recording mode of the recording device, the present invention is extremely effective for not only the recording mode only of a primary color such as black, etc., but also a device equipped with at least one of plural different colors or full color by color mixing, whether the recording head may be constituted integrally or by a combination of plural heads.

The most effective method for the ink as above described in the present invention is based on the film boiling.

Furthermore, the ink jet recording apparatus according to the present invention may be used as an image output terminal in an information processing equipment such as a computer, a copying machine in combination with a reader, or facsimile terminal equipment having a transmission and reception feature.

Though the ink is considered as the liquid in the examples of the invention as above described, another ink may be also usable which is solid below room temperature and will soften or liquefy at or above room temperature, or in a temperature range from 30° C. to 70° C. within which the temperature can be adjusted commonly with the ink jet device. That is, what is needed is that the ink can liquefy when a use recording signal is issued. In addition, in order to avoid the temperature elevation due to heat energy by positively utilizing it as the energy for the change of state from solid to liquid, or to prevent the evaporation of ink by using an ink which is solid when in the on-the-shelf state, the use of an ink having a property of liquefying only with the application of heat energy, such as liquefying with the application of heat energy in accordance with a recording signal so that liquid ink is discharged, or may already solidify upon reaching the recording medium, is also applicable in the present invention. In such a case, the ink may be held as liquid or solid in recesses or through holes of a porous sheet, which is placed opposed to electrothermal converting elements, as described in Japanese Laid-Open Patent Application No. 54-56847 or No. 60-71260. The present invention can be most effectively applied to the film boiling system for each ink as above mentioned.

What is claimed is:

1. A method for manufacturing a liquid jet recording head having a discharge port for discharging ink, a liquid flow path communicating with said discharge port, an electrothermal converting member provided in said liquid flow path to generate thermal energy for discharging ink, and a silicon substrate provided with said electrothermal converting member, said method comprising the steps of:

preparing a silicon substrate provided with an electrothermal converting member;

forming a protective layer for coating said electrothermal converting member on said substrate;

stacking a liquid flow path forming substrate having a first surface composed of a (110) plane of a single crystalline silicon for forming a part of said liquid flow path on said protective layer;

forming a groove as said liquid flow path, by forming an etching mask on a surface of said liquid flow path forming substrate, said groove having a surface (111) plane as a side surface perpendicular to said first surface by anisotropic etching;

forming said liquid flow path by joining a lid plate containing silicon on said liquid flow path forming substrate having the groove and forming a stacked member including said substrate, said liquid flow path forming substrate and said lid plate; and cutting said stacked member at a portion corresponding to said liquid flow path to form said discharge port at a cut surface of said liquid flow path.

2. A method for manufacturing a liquid jet recording head having a discharge port for discharging ink, a liquid flow path communicating with said discharge port, an electrothermal converting member provided in said liquid flow path to generate thermal energy for discharging ink and a silicon substrate provided with said electrothermal converting member, said method comprising the steps of:

preparing a silicon substrate provided with an electrothermal converting member;

preparing a lid plate containing silicon;

stacking a liquid flow path forming substrate having a first surface composed of a (110) plane of a single crystalline silicon for forming a part of said liquid flow path on said lid plate;

forming a groove as said liquid flow path, by forming an etching mask on a surface of said liquid flow path forming substrate, said groove having a surface (111) plane as a side surface perpendicular to said first surface by anisotropic etching;

forming said liquid flow path by joining said substrate on said liquid flow path forming substrate having the groove and forming a stacked member including said substrate, said liquid flow path forming substrate and said lid plate; and cutting said stacked member at a portion corresponding to said liquid flow path to form said discharge port at a cut surface of said liquid flow path.

3. A method according to claim 2, wherein the joining between said liquid flow path forming substrate and said substrate is performed by thermal fusion.

* * * * *

UNITED STATES PATENT AND TRADEMARK OFFICE

CERTIFICATE OF CORRECTION

PATENT NO. : 5,902,492

DATED : May 11, 1999

INVENTOR(S) : TAKUMI SUZUKI, ET AL.

It is certified that error appears in the above-identified patent and that said Letters Patent is hereby corrected as shown below:

COLUMN 5:

Line 12, "groove" should read --a groove--.

COLUMN 7:

Line 3, "which" should read --which is--.

Signed and Sealed this

Fourth Day of January, 2000

*Attest:*

*Attesting Officer*

*Acting Commissioner of Patents and Trademarks*